United States Patent [19]

Edwards et al.

[11] 4,431,468

[45] Feb. 14, 1984

[54] TL-170 BLASTING AGENT

[75] Inventors: Donald W. Edwards, Provo, Utah; Ronald D. Thomas, Arlington Heights, Ill.

[73] Assignee: Angus Chemical Company, Northbrook, Ill.

[21] Appl. No.: 465,241

[22] Filed: Feb. 9, 1983

Related U.S. Application Data

[63] Continuation-in-part of Ser. No. 152,074, May 21, 1980, abandoned.

[51] Int. Cl.[3] ..... C06B 45/02

[52] U.S. Cl. ..... 149/21; 149/2; 149/47; 149/89; 149/110; 149/112

[58] Field of Search ..... 149/2, 21, 47, 89, 110, 149/112

[56] References Cited

U.S. PATENT DOCUMENTS

| | | | |
|---|---|---|---|
| 4,110,134 | 8/1978 | Wade | 149/4 |
| 4,263,068 | 4/1981 | Edwards et al. | 149/8 |
| 4,273,049 | 6/1981 | Edwards et al. | 149/4 |

*Primary Examiner*—Stephen J. Lechert, Jr.

*Attorney, Agent, or Firm*—Leydig, Voit, Osann, Mayer & Holt, Ltd.

[57] ABSTRACT

A granulated blasting agent composition comprising ammonium nitrate, a nitroalkane having of from 2 to 3 carbon atoms and mixtures thereof, a density improver selected from the group consisting of wheat flour and bentonite and polyoxyethylene ether as a thickening agent for the nitroalkane in an amount sufficient to prevent migration of the nitroalkane from the ammonium nitrate.

20 Claims, No Drawings

TL-170 BLASTING AGENT

RELATED APPLICATIONS

This application is a continuation-in-part of Edwards et al. application Ser. No. 152,074 filed May 21, 1980 now abandoned.

BACKGROUND OF THE INVENTION

This invention relates to an improved blasting agent. In a particular aspect this invention relates to a blasting agent characterized by high density with good sensitivity.

It is known from Lawrence, U.S. Pat. No. 2,325,064, to prepare an explosive composition from a nitroalkane of 1–3 carbon atoms, ammonium nitrate and a carbonaceous material such as wood flour, ivory meal, coal and the like. Such compositions proved satisfactory provided they were used promptly after preparation. However, they lost sensitivity with the passage of time and, hence, proved unreliable in field use. It was discovered that this loss of sensitivity was due to lack of affinity between the ammonium nitrate and the nitroalkane, so that the latter collected in the bottom portion of the container. The composition, therefore, became insensitive to the usual detonating devices. Accordingly, there exists a need for providing a means of maintaining a mixture of nitroalkane, ammonium nitrate and a carbonaceous material in a relatively stable, homogeneous state. Also, adventageously the composition should have a high density so that it will sink in wet bore holes, i.e. holes having an appreciable water level.

SUMMARY OF THE INVENTION

It is an object of this invention to provide an improved blasting agent.

It is another object of this invention to provide an improved blasting agent having a high density with good sensitivity.

It is a further object of this invention to provide an improved blasting agent that is a relatively dry granulated product.

Other objects of this invention will be apparent to those skilled in the art from the description herein.

It is the discovery of this invention to provide an improved blasting agent comprising ammonium nitrate, a nitroalkane of 2–3 carbon atoms, a density improving agent and a thickener for the nitroalkane. The composition is a granulated product which is characterized by high density and good sensitivity and retains sensitivity well. It is especially well-adapted for use in large diameter holes.

DETAILED DESCRIPTION

The blasting agent of this invention is a granulated mixture which comprises ammonium nitrate in an amount of about 80–84% by weight mixed with about 2–20% by weight of the nitroalkane, about 2–8% of a density improving agent, hereinafter denoted a densified i.e., an agent which raises the density of the composition, and about 0.1 to 2% of a thickening agent.

The nitroalkane used in preparing the blasting agent of this invention is nitroethane, or preferably nitropropane, or mixtures thereof. Either 1-nitropropane or 2-nitropropane may be used with equally good results. When nitromethane is used as the nitroalkane, the mixture is sufficiently shock sensitive to be classified as an explosive by Department of Transportation tests. When nitroalkanes of 2–3 carbon atoms are used, the sensitivity is that of nitro-carbo-nitrates and hence is classed as a blasting agent.

The ammonium nitrate preferred for the practice of this invention is a mixture of low density, explosive grade ammonium nitrate prills, as known in the art, and comminuted material. The comminuted ammonium nitrate can be used in an amount of from 20% to 80% of the total, preferably 40% by weight, the concentration giving the maximum density. High density prilled ammonium nitrate can also be used, but the thickening agent must be used in the higher portion of the range, i.e. 1–2%.

In the absence of the thickening agent, the liquid nitroalkane migrates rather rapidly, on standing, to the bottom of the ammonium nitrate solids when it is present at more than 15%. This causes the mixture to become insensitive, failing to detonate when initiation is attempted. This migration will also tend to occur at lower concentrations of nitroalkane. To prevent this, a thickening agent is included in the formulation. The thickening agent thickens the liquid nitroalkane to inhibit the flow of liquid nitroalkane away from the ammonium nitrate which typically occurs due to lack of affinity between the ammonium nitrate and nitroalkane, and this effectively eliminates any undesired separation of those two components. A relatively dry granulated product which is characterized by, among other things, a good shelf life, i.e. improved retention of sensitivity, is thus provided. The preferred thickening agent is a polyoxyethylene ether of a molecular weight of approximately 4,000,000. These ethers are represented by the formula $\leftarrow O-CH_2CH_2 \rightarrow_n$. A particularly preferred product is Polyox 301 of −60 mesh marketed by Union Carbide Corporation.

The amount of thickening agent to be used varies with the nitroalkane and the amount used. It is more effective with nitroethane than with nitropropane. With a nitroalkane content of, e.g., 15–20%, from 1–2% of thickening agent is preferred. With a nitroalkane content of 10–15%, from 0.5–1.0% is satisfactory. At lower nitroalkane content, from 0.1 for nitroethane to 0.5% for nitropropane is suitable. For most formulations of nitropropane 0.5–1.0% is suitable. Generally, for most formulations of nitroalkanes of 2–3 carbon atoms, 0.5–1.0% thickening agent is preferred. It is understood that these amounts are approximations only, and it is not intended that the ratios be followed slavishly. The lower amounts of thickening agent also require a longer mixing time for thorough mixing throughout the ammonium nitrate.

The densifier can be either wheat flour or bentonite. The former tends to reduce the sensitivity and is, therefore, preferred, especially when lower sensitivity is desired.

The wheat flour used in the practice of this invention is known as crop wheat flour. It is whole ground wheat, 98% of which passes a No. 70 sieve. It has a loose bulk density of 0.56 g/cc. At 14% moisture, the protein content is 15.4% and ash is 1.5%.

The wheat flour, which is an absorbent material, is helpful in binding the nitroalkane and thus aids in preventing the nitroalkane from migrating away from the solid oxidizer material, i.e., the ammonium nitrate. Wheat flour may thus be used in conjunction with the thickening agent to prevent separation of nitroalkane and ammonium nitrate. Accordingly the amount of ickening agent used varies depending upon the nount of wheat flour used. The greater the amount of heat flour present in the composition, the lower will e the amount of thickening agent that is required to revent the undesired migration described above. Vheat flour alone, that is, without any thickening gent, may be used provided it is present in an amount ifficient to prevent the migration of nitroalkane from ie ammonium nitrate. When wheat flour is present in i amount of about 12 wt.% of the composition, a thickning agent is not required. However, the relative nounts of wheat flour and thickening agent should be alanced, as described more fully hereinafter, to proide a blasting agent having other desirable properties ich as satisfactory density and explosive properties.

The bentonite used in the practice of this invention an be either the Southern or the Western type and referably is used in an amount of about 4%. Preferably, ie bentonite is comminuted, e.g. about −200 mesh. he bentonite is also helpful in preventing the liquid itroalkane component from migrating to the bottom of ie package when it is present at more than 15%, but ie thickening agent is primarily effective to prevent iis from happening.

The relative amounts of, or ratio, between the wheat our and thickening agent is important to both the xplosive property and density of the blasting agent of ie present invention. The explosive property or critical iameter—i.e., the diameter below which a cylinder of ie blasting agent will not propogate an explosion—of ie blasting agent can be varied depending upon the elative amount of wheat flour and thickening agent tilized in the composition. Thus, for example, for the vel of polyoxyethylene ether utilized in the composion of the present invention (0.1 wt.% to 2.0 wt.%) hen wheat flour is present in an amount of from about % to about 4% by weight the composition is especially itable for small diameter holes, i.e., holes of about 3" 4" in diameter, while, for the same level of polyoxyhylene ether, when wheat flour is present in an nount of from about 4% to about 12%, the composion is especially suitable for large diameter holes, i.e. oles of about 8" to 12" in diameter.

Density also varies as the weight ratio of wheat flour thickening agent varies. Thus as the ratio of wheat our to thickening agent increases the density of the lasting agent composition increases and conversely, as ie ratio of wheat flour to thickening agent decreases, ie density of the blasting agent composition decreases.

As is known, the strength or explosive capability of a lasting agent is a function of the density of the blasting omposition. Accordingly, by varying the density of ie product and by effecting the appropriate ratio of heat flour and thickening agent, the blasting agent omposition of the present invention can be tailored to particular end use.

The composition of this invention is readily prepared y mixing the ingredients for a few minutes in a convenonal manner and discharging the mixture into suitable ontainers, e.g. plastic bags. However, the order in hich the components are mixed is significant. The ickening agent should be the last addition in formulaon of the composition in order to maintain the high ensity of the final product. If the thickening agent is ot the last component added, then there results a prodct of lower density.

The blasting agent composition of the present invenon is especially useful in bore holes. It is heavier than water, so if water collects in the bore hole, the blasting agent sinks without difficulty. It can be detonated by the usual boosters and primers, as known in the art, preferably a cast primer. Also at least two primers should be used in each column of blasting agent, and under extremely severse loading conditions, or where powder column separations are possible, additional primers should be used to preclude cutoffs.

The composition has a detonation rate, 5 in. diameter unconfined, of 13,743 feet per second (4190 meters/sec.) and a detonation pressure of 50 Kbars. It is not sensitive to a No. 8 cap and is not detonated by the impact of a 30 calibre rifle bullet.

Typically, and preferably, it will have the following composition and properties.

| | |
|---|---|
| Ammonium nitrate | 82% |
| Whole prills 30% | |
| Ground prills 70% | |
| Nitropropane | 13% |
| Bentonite | 4% |
| Polyoxyethylene ether | 1% |
| Total | 100% |

It is an embodiment of this invention or provide a finished, packaged blasting agent comprising the blasting agent described hereinbefore packaged in a laminated nylon bag of from 4 to 8 inches in diameter. The nylon is at least 1.25 mil thickness, there being no upper limit as to thickness. However, 1 mil thickness nylon film is relatively easily torn and punctured and because heavier gauge nylon is relatively expensive, it is preferred to employ the nylon bag in conjunction with polyethylene, such as Plexar. The nylon can be laminated to the polyethylene or it can merely be formed into a bag heat sealed at one end and inserted in a polyethylene bag, also heat sealed at one end. Such a packaging system wherein the nylon is of from 1 to 2 mil and the polyethylene is from 4–5 mil has proven very successful. A laminated bag wherein the nylon is sandwiched between two layers of polyethylene is preferred.

Nylon is the only film so far discovered which will contain nitroalkanes for a satisfactory shelf-life period. All others tested have apertures and voids, which, though microscopic, are sufficient to permit the nitroalkane to evaporate and the blasting agent thereby becomes insensitive and useless.

The invention will be better understood with reference to the following examples. It is understood, however, that the examples are intended only to illustrate the invention, and it is not intended that the invention be limited thereby.

EXAMPLE 1

A sample of explosive grade, uncoated, prilled ammonium nitrate was ground through a ⅛-inch screen manufactured by the Gruendler Corporation. The comminuted material was mixed with unground prills in a 1:1 by weight ratio. The mixture had the following screen analysis:

| | |
|---|---|
| +18 | 58.75% |
| +35 | 16.25% |
| +60 | 12.5 % |
| +80 | 3.75% |
| +120 | 3.75% |
| +230 | 3.75% |

-continued

| | |
|---|---|
| −230 | 1.25% |

The mixed ammonium nitrate, 82 g, 1-nitropropane 13 g, wheat flour 4 g and 1% of 60 mesh polyoxyethylene ether (Polyox 301 marketed by Union Carbide Corporation) has a standard density of 1.22 and after standing 24 hours was sensitive to the shock of 10 g of Pentolite (a mixture of pentaerythritol tetranitrate and trinitrotoluene). The unconfined rate of detonation in a 3-inch diameter column was 10,200 ft/sec.

The mixture was used to fill a 5-inch diameter nylon bag of 1.25 mil thickness, heat sealed on one end and encased in a 4 mil polyethylene bag. The 1-NP did not rise to the top and the mixture retained good sensitivity on standing. A similar mixture but without the wheat flour or Polyox was prepared and similarly packaged in a nylon bag with polyethylene outer bag. Upon standing a brief period, the liquid portion drained away from the ammonium nitrate in the upper portion of the bag and puddled in the bottom of the bag. The mixture was insensitive to a No. 8 blasting cap and did not detonate on initiation.

EXAMPLE 2

The experiment of Example 1 was repeated in all essential details except that 2-nitropropane (2-NP) was substituted for 1-NP. The resulting mixture was satisfactory in all respects.

EXAMPLE 3

The experiment of Example 1 is repeated in all essential details except that nitroethane is substituted for 1-nitropropane. The resulting mixture is satisfactory in all respects.

EXAMPLE 4

The experiment of Example 1 is repeated in all essential details except that bentonite was substituted for wheat flour. The resulting mixture was satisfactory in all respects.

Thus, as can be seen, the present invention provides an improved blasting agent characterized by high density and good sensitivity. Further, the composition retains sensitivity on standing, and can be utilized for both large and small diameter holes.

We claim:

1. A blasting agent composition comprising ammonium nitrate, a nitrolalkane having of from 2 to 3 carbon atoms, or mixtures thereof, a density improver selected from the group consisting of wheat flour and bentonite and polyoxyethylene ether as thickening agent for the nitroalkane in an amount sufficient to prevent migration of the nitroalkane from the ammonium nitrate.

2. The composition of claim 1 wherein the nitroalkane is present in an amount of from about 2 to about 20% by weight of the composition.

3. The composition of claim 2 wherein nitroalkane i present in an amount of about 13% by weight of th composition.

4. The composition of claim 1 wherein the polyoxy ethylene ether is present in an amount of from about 0.! to about 1.0 wt.%.

5. The composition of claim 1 wherein the polyoxy ethylene ether is −60 mesh size.

6. The composition of claim 1 wherein the density improver is present at about 2–8% by weight.

7. The composition of claim 1 wherein the ammonium nitrate consists of comminuted ammonium nitrate and granular ammonium nitrate in a ratio of abou 80–100:20–0 respectively.

8. The composition of claim 7 wherein the ammonium nitrate is 100% comminuted.

9. A granulated blasting agent composition comprising from about 80 to about 84 wt.% ammonium nitrate, from about 2 to about 20 wt.% of a nitroalkane having of from 2 to 3 carbon atoms and mixtures thereof, from about 2 to about 8 wt.% of a density improver selected from the group consisting of wheat flour and bentonite and from about 0.1 to about 2 wt.% of polyoxyethylene ether as a thickening agent for the nitroalkane to prevent migration of the nitroalkane from the ammonium nitrate.

10. The composition of claim 9 wherein the polyoxyethylene ether is present in an amount of from about 0.5 to about 1.0 wt.%.

11. The composition of claim 10 wherein the polyoxyethylene is −60 mesh size.

12. The composition of claim 9 wherein the ammonium nitrate consists of comminuted ammonium nitrate and granular ammonium nitrate in a ratio of about 80–100:20–0, respectively.

13. The composition of claim 12 wherein the ammonium nitrate is 100% comminuted.

14. A granulated blasting agent composition comprising ammonium nitrate, a nitroalkane having of from 2 to 3 carbon atoms, or mixtures thereof, and wheat flour to increase the density of the composition and present in an amount sufficient to prevent migration of the nitroalkane from the ammonium nitrate.

15. The composition of claim 14 wherein the ammonium nitrate is present in an amount of from about 80–84 wt.%, the nitroalkane is present in an amount of from about 2 to about 20 wt.% and the wheat flour is present in an amount of about 12 wt.%.

16. A packaged unit of the blasting agent of claim 1 comprising the blasting agent packaged in a nylon bag.

17. The packaged unit of claim 16 wherein the nylon bag is encased in a polyethylene bag.

18. The packaged unit of claim 17 wherein the nylon is of 1–2 mil thickness and the polyethylene is of from 4–5 mil thickness.

19. A packaged unit of the blasting agent of claim 1 comprising the blasting agent packaged in a laminated bag of nylon film laminated between two layers of polyethylene.

20. The composition of claim 7 wherein the comminuted ammonium nitrate and prilled ammonium nitrate are in a ratio of about 1:1.

* * * * *

UNITED STATES PATENT AND TRADEMARK OFFICE

CERTIFICATE OF CORRECTION

PATENT NO. : 4,431,468

DATED : February 14, 1984

INVENTOR(S) : Donald W. Edwards

It is certified that error appears in the above-identified patent and that said Letters Patent is hereby corrected as shown below:

Column 4, line 6, "severse" should read -- severe --.

Column 5, line 54, "nitrolakane" should read -- nitroalkane --.

Signed and Sealed this

*Thirtieth* Day of *April 1985*

[SEAL]

*Attest:*

DONALD J. QUIGG

*Attesting Officer*

*Acting Commissioner of Patents and Trademarks*